US010646910B2

(12) United States Patent
Passone

(10) Patent No.: US 10,646,910 B2
(45) Date of Patent: May 12, 2020

(54) METHODS FOR THE PRODUCTION OF CURVED PIECES FROM CONTINUOUS METAL ELEMENTS

(71) Applicant: BAOMARC AUTOMOTIVE SOLUTIONS S.P.A., Vinovo (Turin) (IT)

(72) Inventor: Pietro Passone, Vinovo (IT)

(73) Assignee: BAOMARC AUTOMOTIVE SOLUTIONS S.P.A., Vinovo (Turin) (IT)

( * ) Notice: Subject to any disclaimer, the term of this patent is extended or adjusted under 35 U.S.C. 154(b) by 360 days.

(21) Appl. No.: 15/546,678

(22) PCT Filed: Dec. 16, 2015

(86) PCT No.: PCT/IB2015/059678
§ 371 (c)(1),
(2) Date: Jul. 27, 2017

(87) PCT Pub. No.: WO2016/120698
PCT Pub. Date: Aug. 4, 2016

(65) Prior Publication Data

US 2018/0001366 A1 Jan. 4, 2018

(30) Foreign Application Priority Data

Jan. 30, 2015 (IT) ..... TO2015A0068

(51) Int. Cl.
*B21D 7/08* (2006.01)
*B21D 7/024* (2006.01)
*B21D 11/02* (2006.01)

(52) U.S. Cl.
CPC ..... *B21D 7/024* (2013.01); *B21D 7/08* (2013.01); *B21D 11/02* (2013.01)

(58) Field of Classification Search
CPC . B21D 5/14; B21D 7/024; B21D 7/08; B21D 7/085; B21D 11/02; B21D 11/203;
(Continued)

(56) References Cited

U.S. PATENT DOCUMENTS 3,863,483 A * 2/1975 Wright ..... B21D 7/024 72/219
4,054,982 A * 10/1977 Damman ..... B21D 7/08 29/894.35
(Continued)

FOREIGN PATENT DOCUMENTS

DE 102004015073 B3 10/2005
DE 102004033200 B3 10/2005
(Continued)

OTHER PUBLICATIONS

1Eurobendsa, Automatic Stirrup Bending Machine G Star Eco, https://www.youtube.com/watch?v=tgY5XuqwYbs (Year: 2012).*

*Primary Examiner* — Adam J Eiseman
*Assistant Examiner* — Bobby Yeonjin Kim
(74) *Attorney, Agent, or Firm* — Meunier Carlin & Curfman LLC

(57) ABSTRACT

Methods for making curved pieces from continuous metal elements are provided. Such methods include advancing a continuous metal element through a calendering station such that each length of the element assumes a pre-established curvature; stopping advancement of the element after a curved length thereof has passed through a wrap-bending station located downstream of the calendering station; wrap-bending the length of the element located at the station, while simultaneously conveying the curved portion to a stretch-bending station; stretch-bending the curved portion; resuming advancement of the element until the wrap-bent length is at a cutting station; and cutting the element in the
(Continued)

wrap-bent length, thus producing the desired curved piece. Curved pieces produced by such methods are also provided.

8 Claims, 10 Drawing Sheets

(58) Field of Classification Search
CPC .... B21D 21/00; B21D 35/002; B21D 35/003; B21D 43/00
USPC ..... 72/166, 168, 169
See application file for complete search history.

(56) References Cited

U.S. PATENT DOCUMENTS 4,318,289 A * 3/1982 Eaton ..... B21C 37/0807 72/131
4,959,984 A * 10/1990 Trudell ..... B21D 7/024 72/150
5,406,692 A * 4/1995 Oishi ..... B21D 7/024 140/102
6,418,773 B1 * 7/2002 Tolman ..... B21D 7/024 72/218
2005/0092053 A1 5/2005 Zhou
2013/0305798 A1 * 11/2013 Lee ..... B21D 7/08 72/31.07
2015/0183017 A1 * 7/2015 Kim ..... B21D 35/001 72/130
2016/0107217 A1 * 4/2016 Del Fabro ..... B21D 7/022 72/275

FOREIGN PATENT DOCUMENTS

EP 2123372 A1 11/2009
IT 0001401375 B1 7/2013

* cited by examiner

METHODS FOR THE PRODUCTION OF CURVED PIECES FROM CONTINUOUS METAL ELEMENTS

CROSS-REFERENCE TO RELATED APPLICATIONS

This application is a National Phase Application of PCT International Application No. PCT/IB2015/059678, International Filing Date, Dec. 16, 2015, claiming priority to Italian Patent Application No. TO2015A000068, filed Jan. 30, 2015 each of which is hereby incorporated by reference in its entirety.

FIELD OF THE INVENTION

The present invention relates to a method for the production of curved pieces from an oblong continuous metal element, such as a profiled element, a tube or the like, having virtually any cross section.

SUMMARY OF THE INVENTION

An object of the present invention is to provide a method which is an improvement over those described in the prior art, particularly a method such that it allows any desired curved shape to be produced by operations performed in a single production line, without the need for temporary storage of blanks, batches of which must subsequently be transferred to the installations designated for the various stages of operation.

According to the invention, this object is achieved by means of a method for the production of a curved piece from a continuous metal element extending along a longitudinal axis and advancing along a direction defined by said longitudinal axis, the aforesaid method comprising, in order of listing, the steps of:

- advancing said element through a calendering station in such a way that each length of the element assumes a pre-established curvature,
- stopping the advancing of the element after a curved portion thereof has passed through a wrap-bending station located downstream of the calendering station,
- wrap-bending the length of the element located at said wrap-bending station, while simultaneously conveying said curved portion to a stretch-bending station,
- stretch-bending said curved portion,
- resuming the advance of the element until the wrap-bent length is at a cutting station, and
- cutting said element in the wrap-bent length, thus producing the curved piece.

The method according to the invention is simple and versatile, and can be fully executed on a single production line, for example a line located downstream of a profiling machine which shapes in the desired way the cross section of the continuous element from which the pieces are cut after they have been curved in the desired way. These pieces are, in principle, finished pieces, and therefore require no intermediate storage, but can be immediately palletized for dispatch to the end user.

Other advantages and characteristics of the present invention will be apparent from the following detailed description which is given by way of non-limiting examples with reference to the attached drawings.

DETAILED DESCRIPTION

Figure 10:
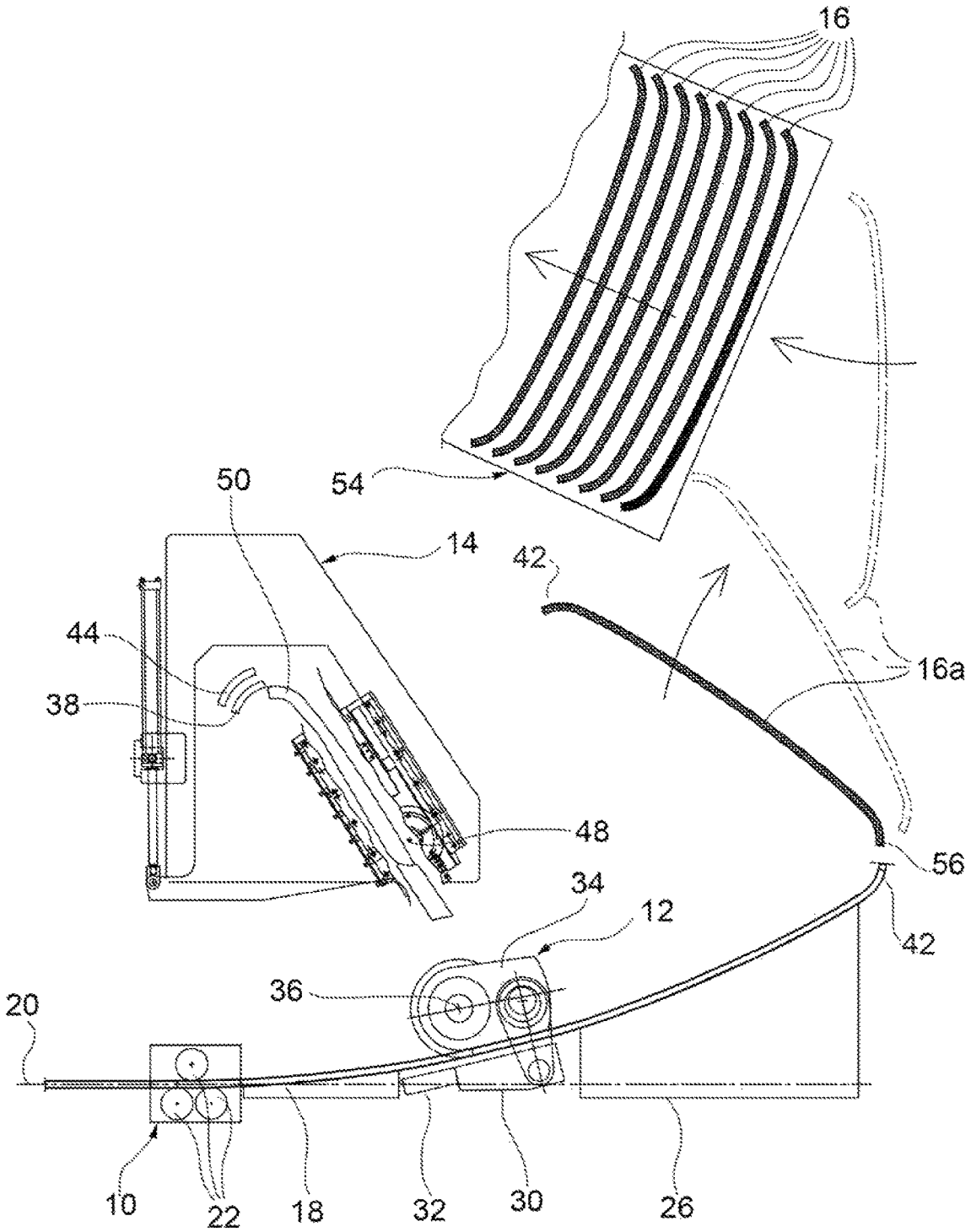

In these figures, the reference numerals 10, 12 and 14 indicate, respectively, a calendering station, a wrap-bending station, and a stretch-bending station, which can be used to produce curved pieces 16 (see FIG. 10) from a continuous metal element 18 extending along a longitudinal axis 20 which also defines its direction of advance. The element 18 may be, for example, a profiled element or tube whose cross section may be of virtually any shape.

Initially, the element 18 advances (FIG. 1) through the calendering station 10, comprising in a known way a plurality of rollers 22 which are selectively movable relative to one another to form a passage for the element 18, in such a way that each length of the element assumes a pre-established curvature. In principle, this curvature can be determined independently for each length of the element 18, and can therefore be constant or variable, possibly from point to point.

Figure 2:
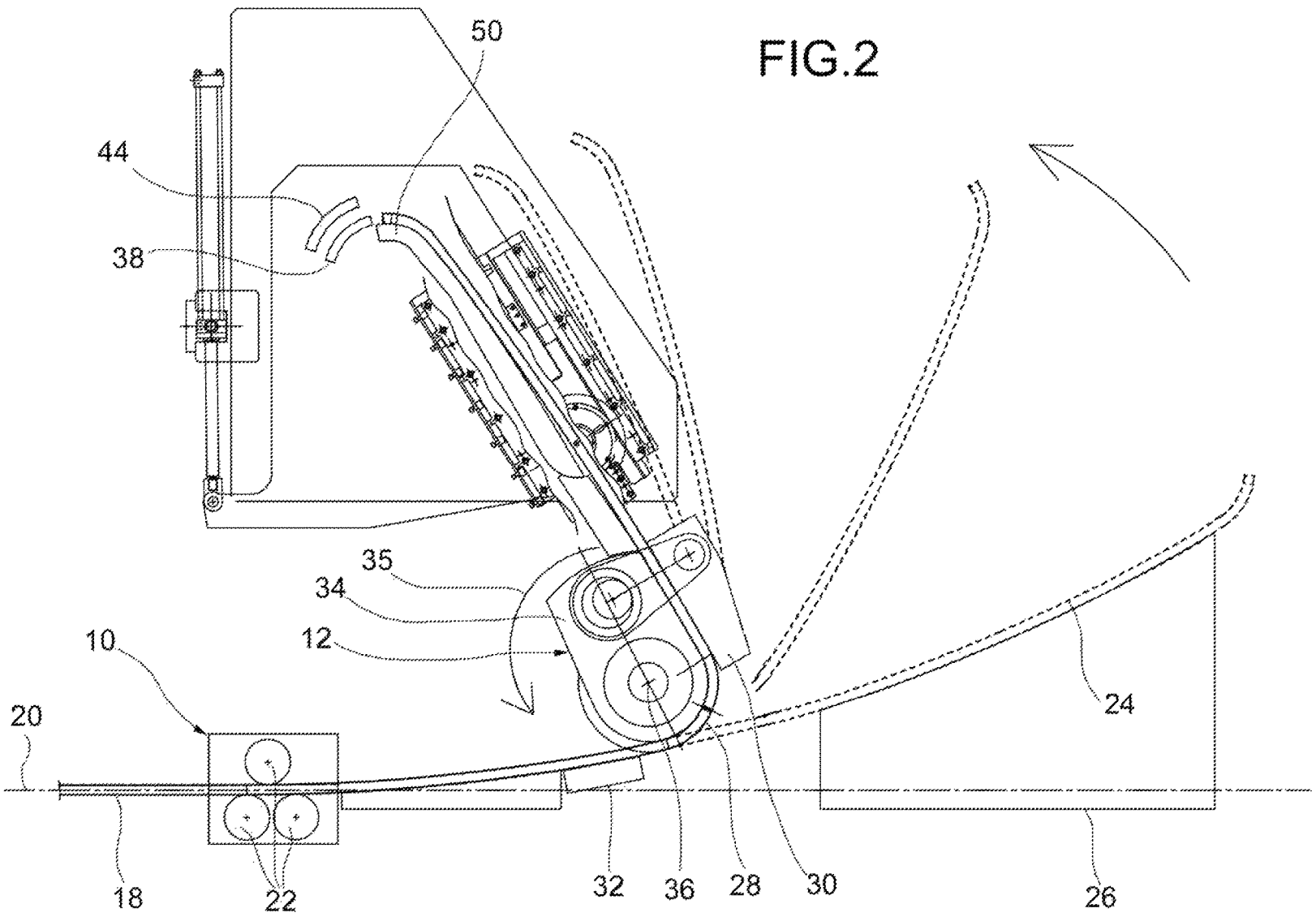

After a curved portion 24 of the element 18 having a length matching that of one of the pieces 16 to be produced has passed through the wrap-bending station 12 located downstream of the calendering station 10, and is supported by a suitable support 26, the advance of the element 18 is stopped, the length 28 of the element located at the station 12 being gripped by a block 30, and the preceding length being gripped by a hold-down member 32. In a known way, the block 30 and the body 34 of the station 12 rotate (see arrow 35 in FIG. 2) about a pivot 36 so that the portion 28 of the element 18 is strongly curved, while the portion 24 downstream of the element 18 is brought to the stretch-bending station 14.

Figure 3:
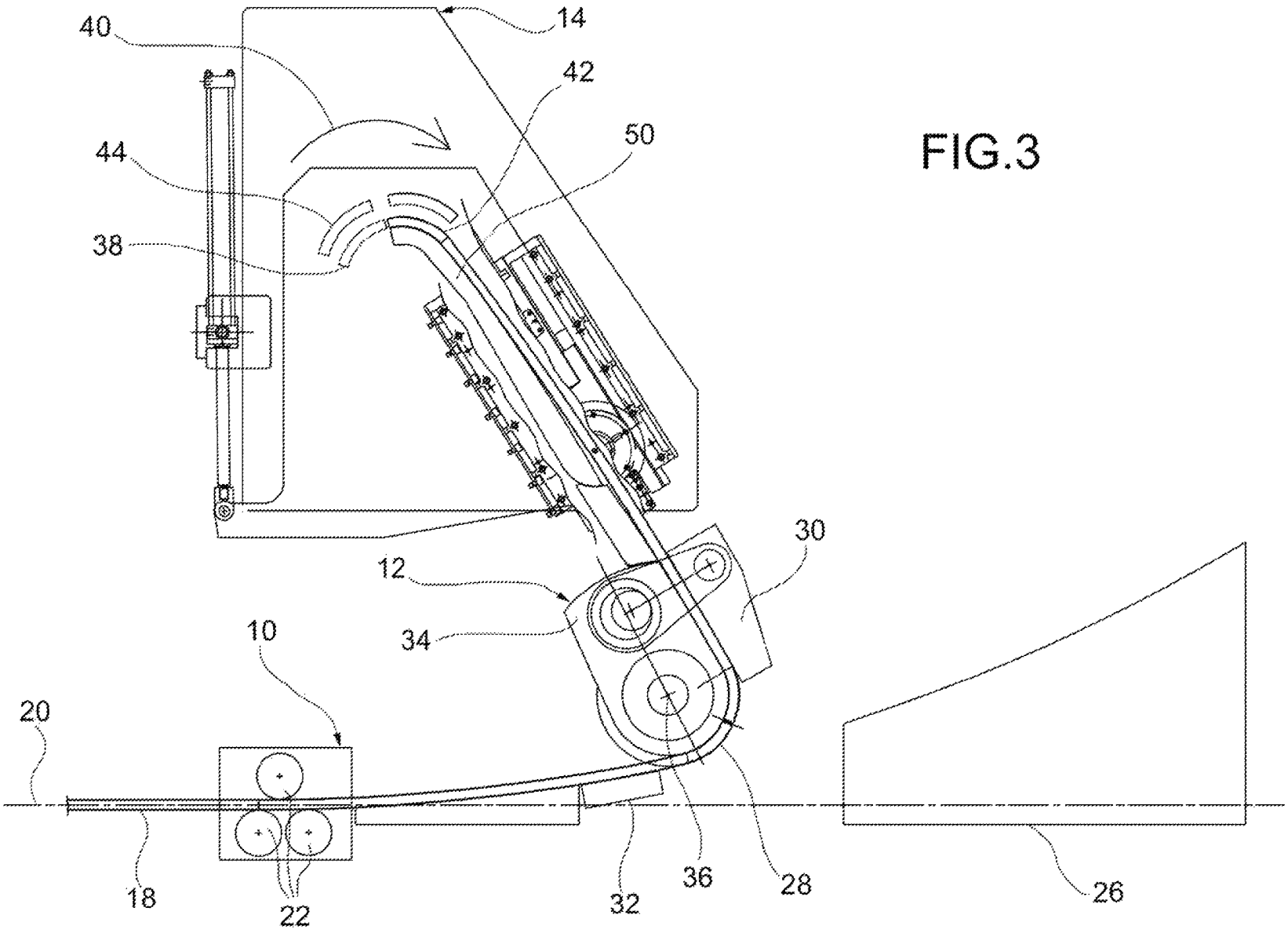

If the element 18 is tubular, a core 38 for preventing undesired deformation of its cross section is inserted (see arrow 40 in FIG. 3) into the distal end 42 of the element 18 which has been curved in a preceding operating cycle. On the other hand, if the element 18 is a profiled element, the step of inserting the core 38 into its distal end 42 is not necessary.

Figure 4:
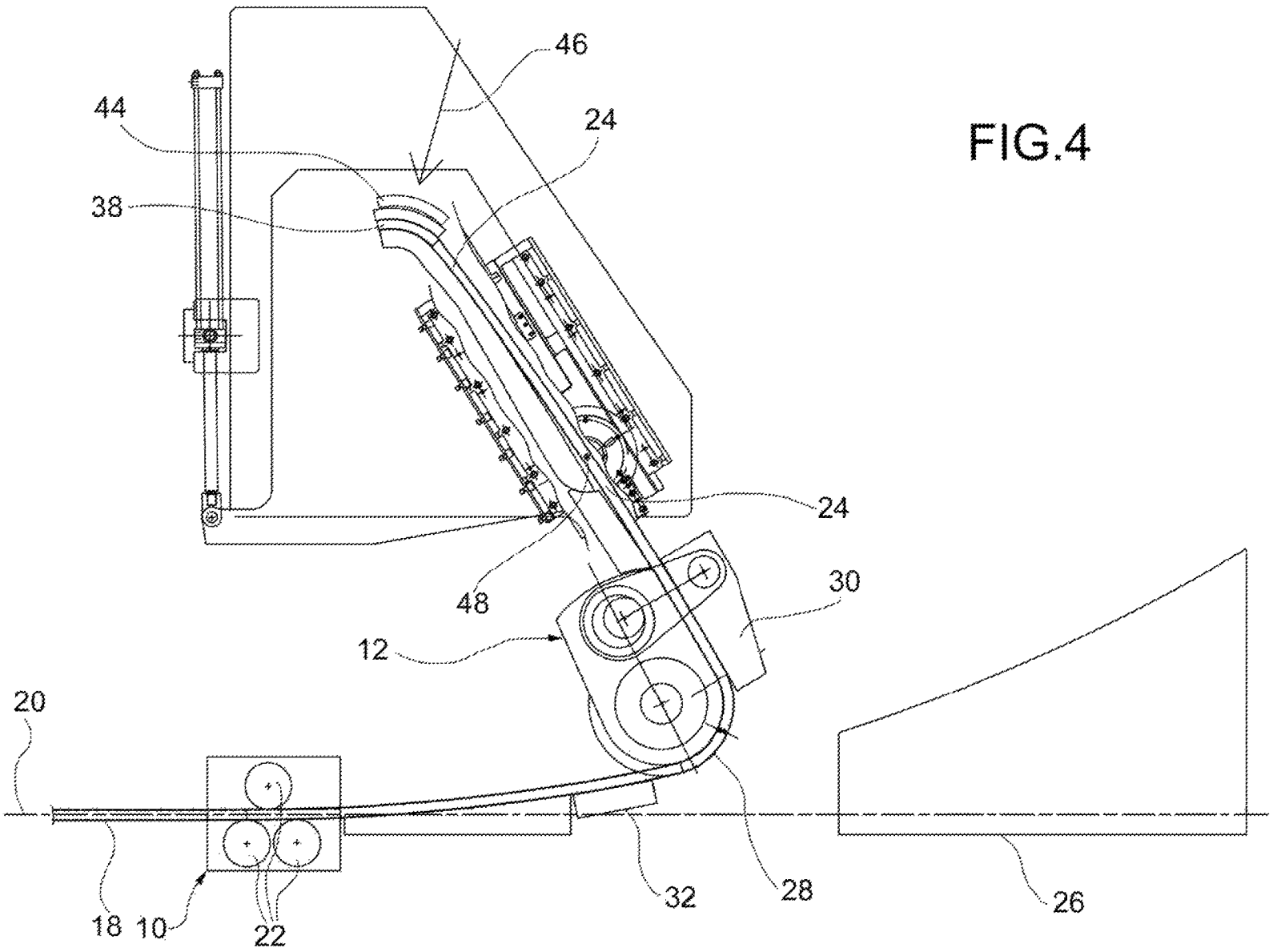
Figure 5:
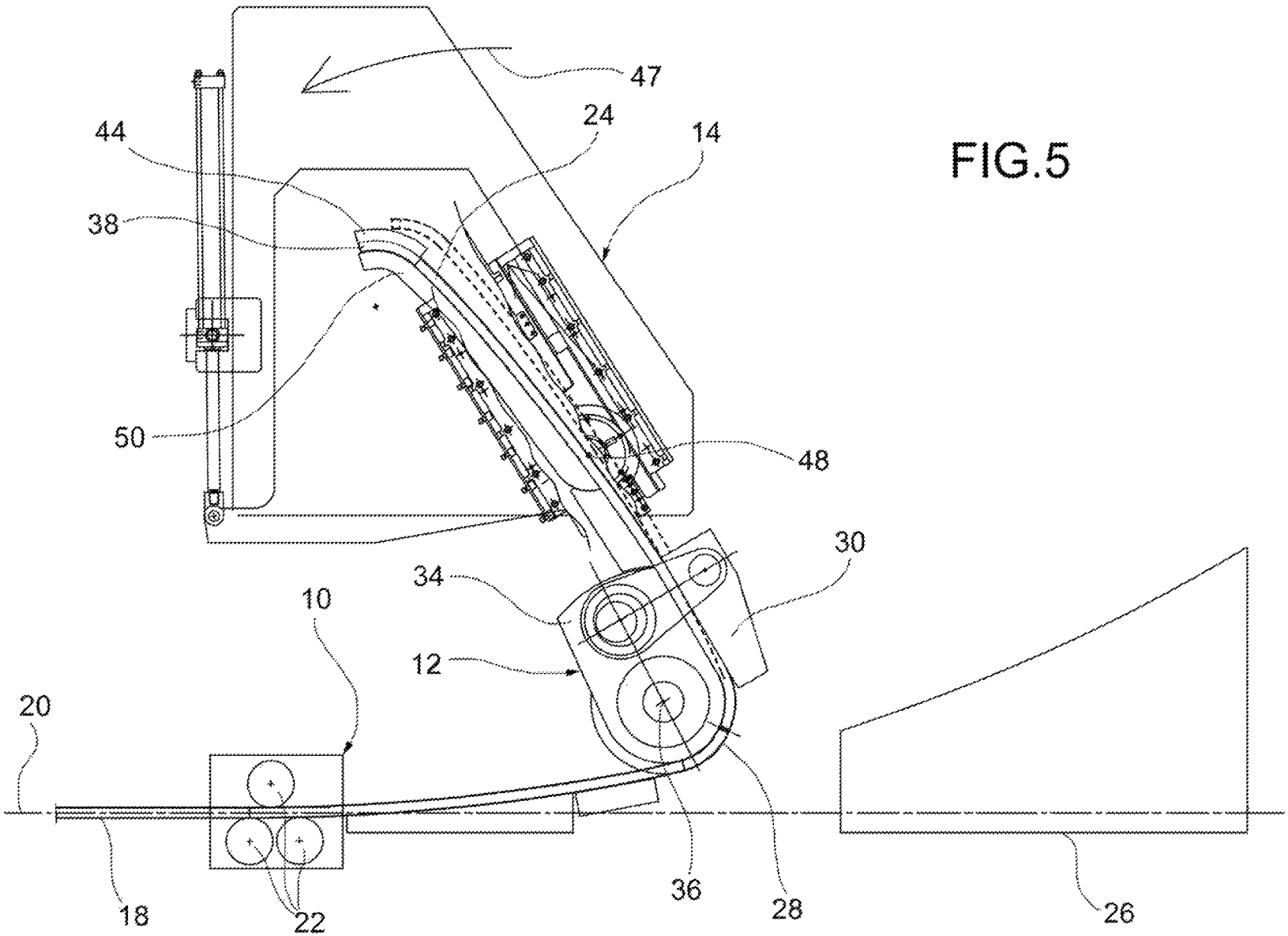

A clamp 44 (see arrow 46 in FIG. 4) then locks the distal end 42 in the station 14. This station is also of a known type, such as that described in the patent IT 1 401 375, and, as a result of a rotary movement about a translating pivot 48 of a shaping element 50 which comes into contact with the portion 24 of the element 18 (see arrow 47 in FIG. 5), the element is simultaneously bent and stretched. This causes an elongation of the bent portion 24, destroying its shape memory and consequently its tendency to return elastically to the original, non-deformed configuration, by operating in the permanent deformation region of the material.

Figure 6:
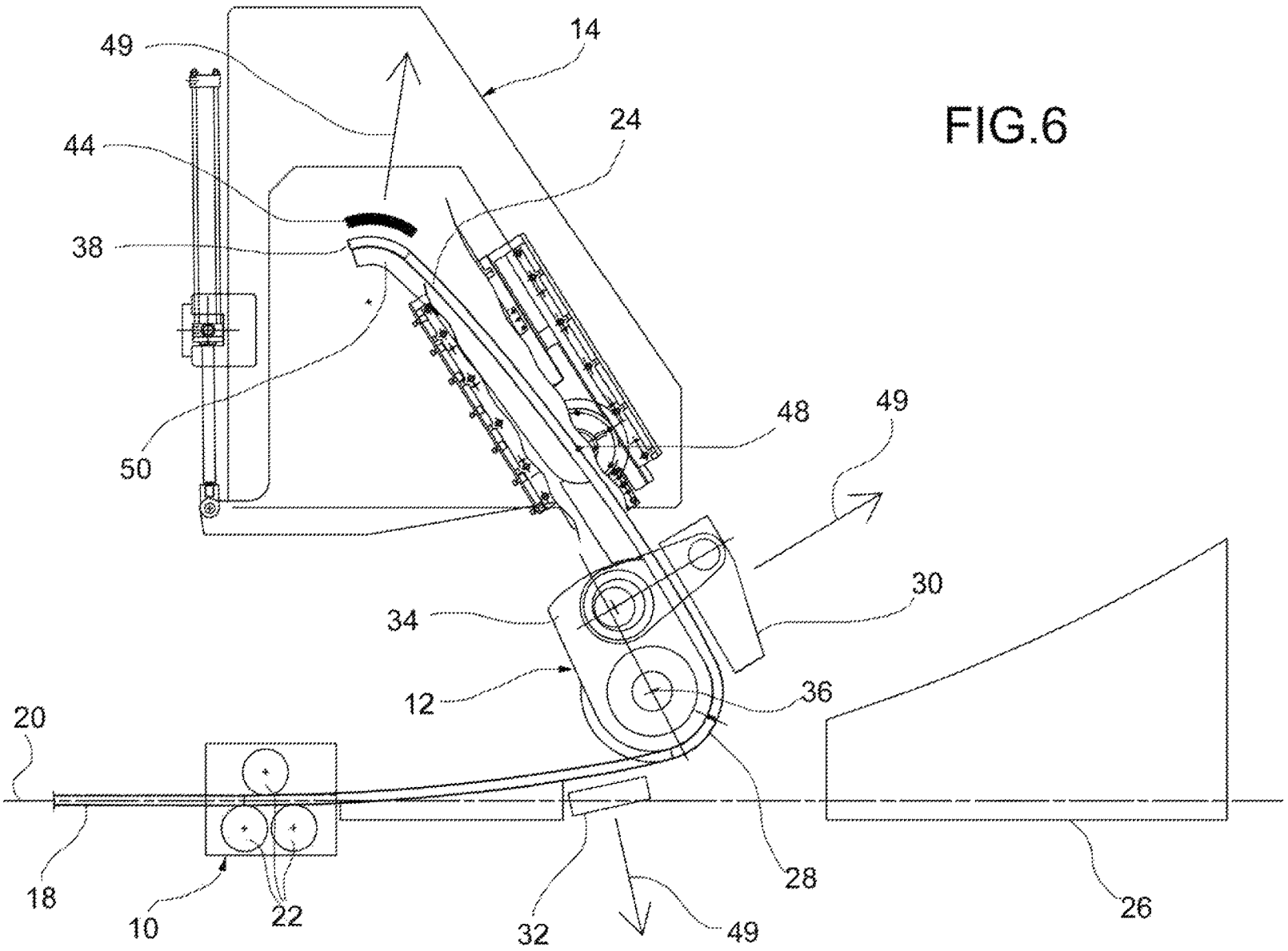
Figure 7:
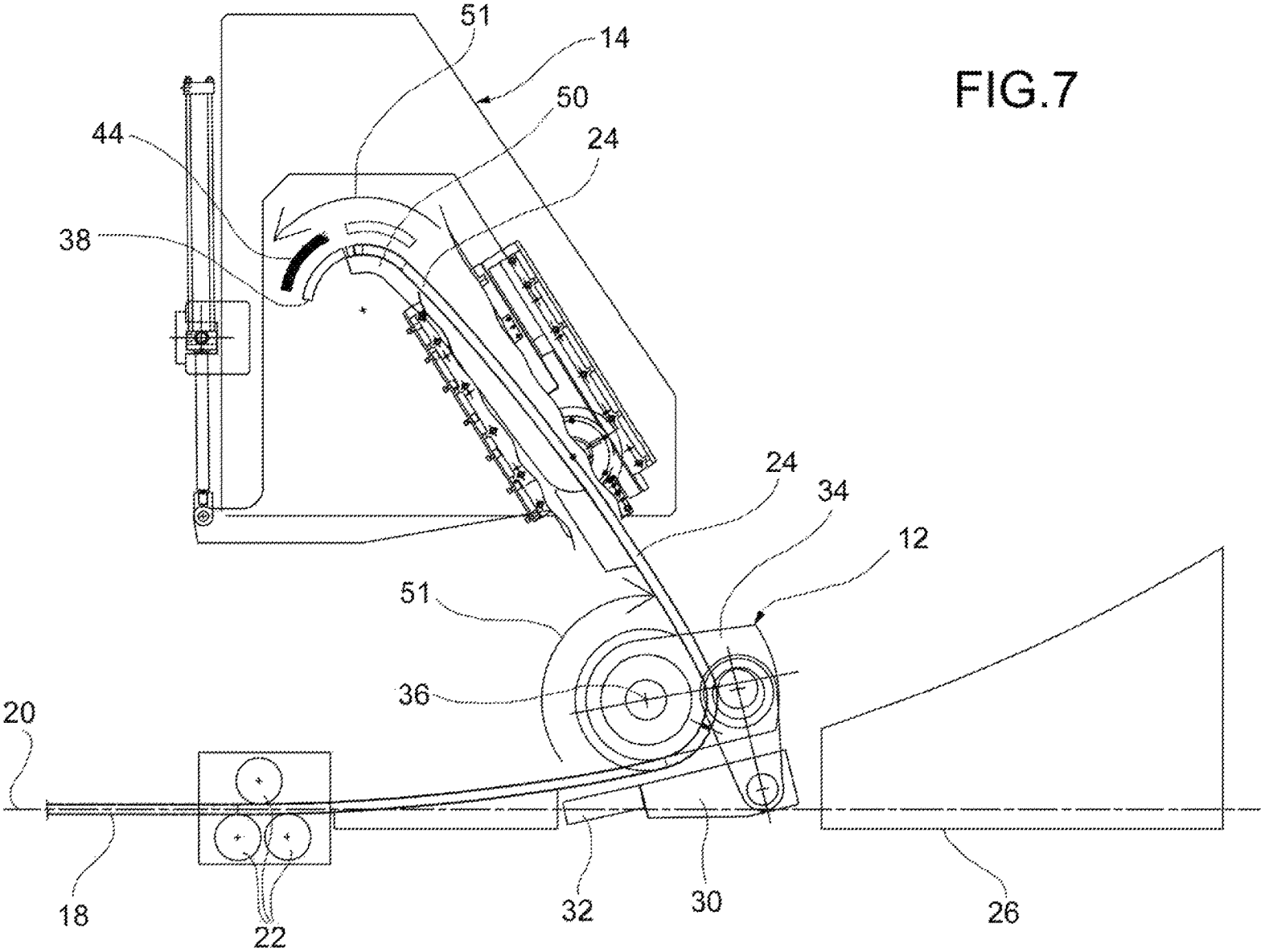

On completion of the stretch-bending step, the clamp 44, the block 30 and the hold-down member 32 are initially disengaged from the element 18 (see arrows 49 in FIG. 6) and then moved away from it (see arrows 51 in FIG. 7) to allow its subsequent movement. To allow this movement, the core 38, if present, is also extracted from the inner cavity of the element 18.

Figure 8:
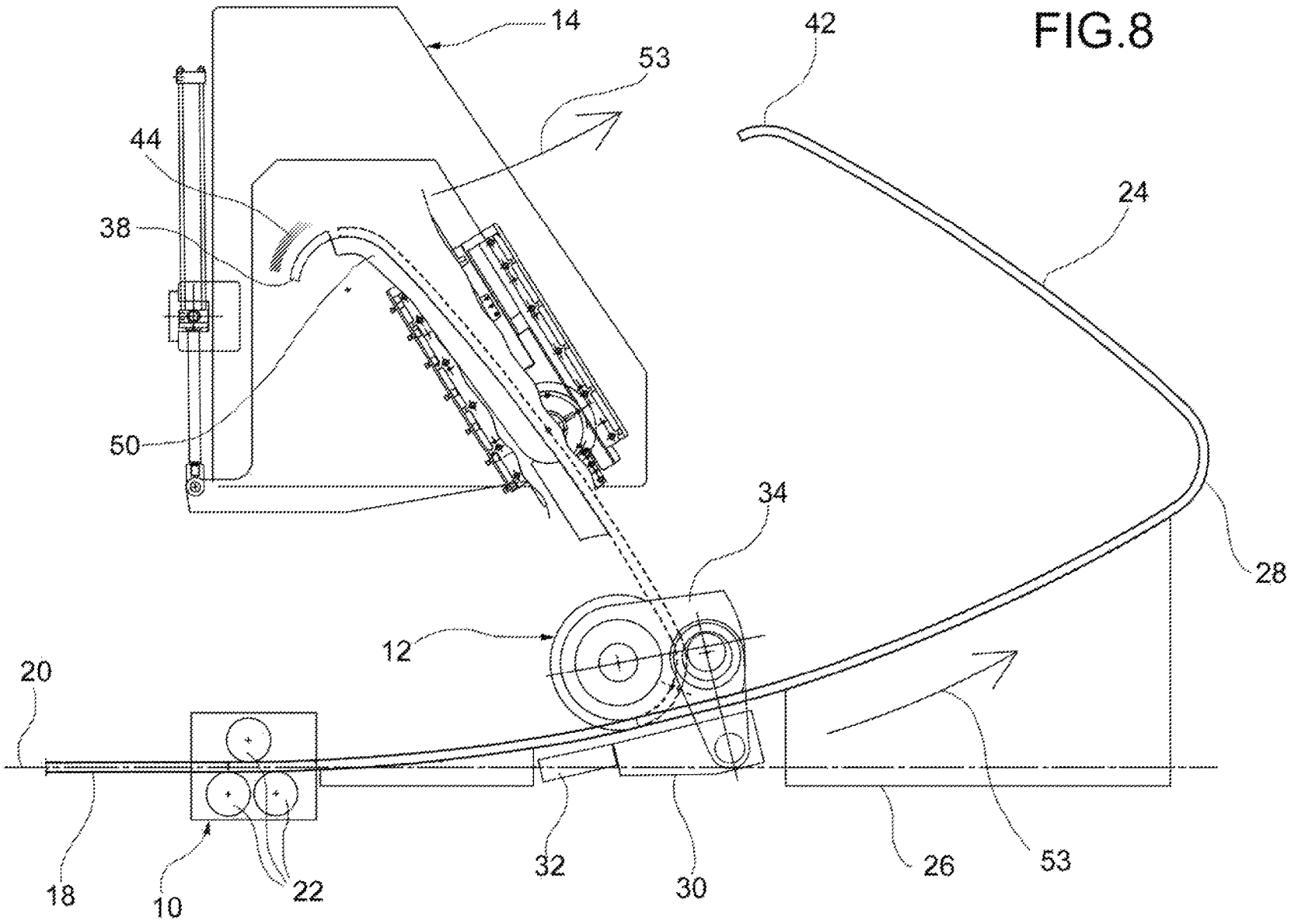
Figure 9:
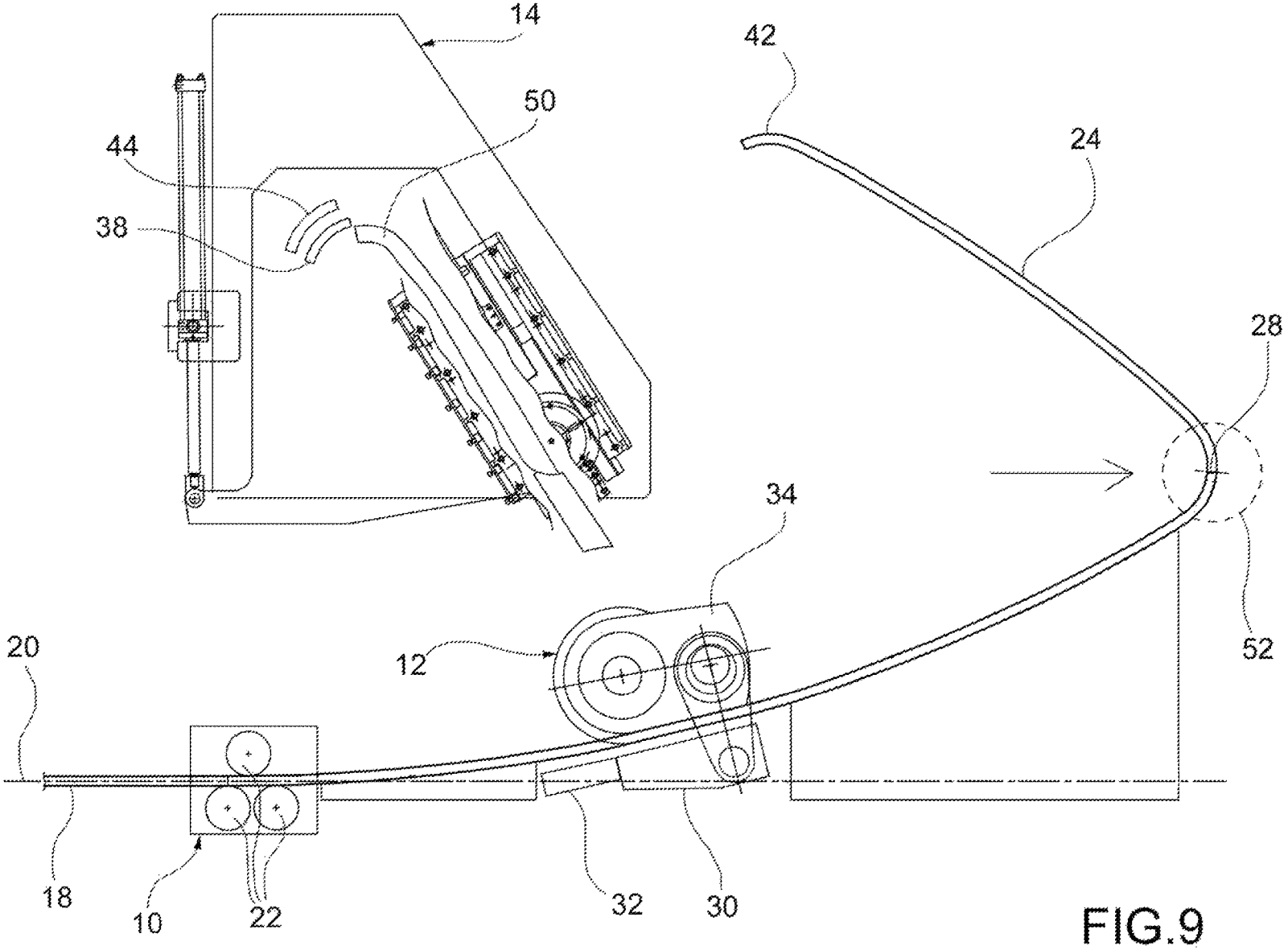

The advance of the element 18 is then resumed (see arrows 53 in FIG. 8) along a length matching that of one of the pieces 16 to be produced, until the length 28 which has been wrap-bent is located (FIG. 9) at a cutting station 52, which is also of a known type, for example a laser cutting station.

Here the element 18 is cut approximately in the center of the wrap-bent length 28, producing (FIG. 10) the final curved piece 16*a* which can be loaded directly onto a pallet 54 together with the pieces 16 produced in previous operating cycles. In this case, the illustrated pieces 16 are ribs having strongly curved ends and a gently curved central portion, but clearly they could be made in any shape, since the final curvature of each length of each piece 16 can be determined independently of that of the adjacent lengths as a result of the various operations performed at the stations 10, 12, and 14.

Figure 1:
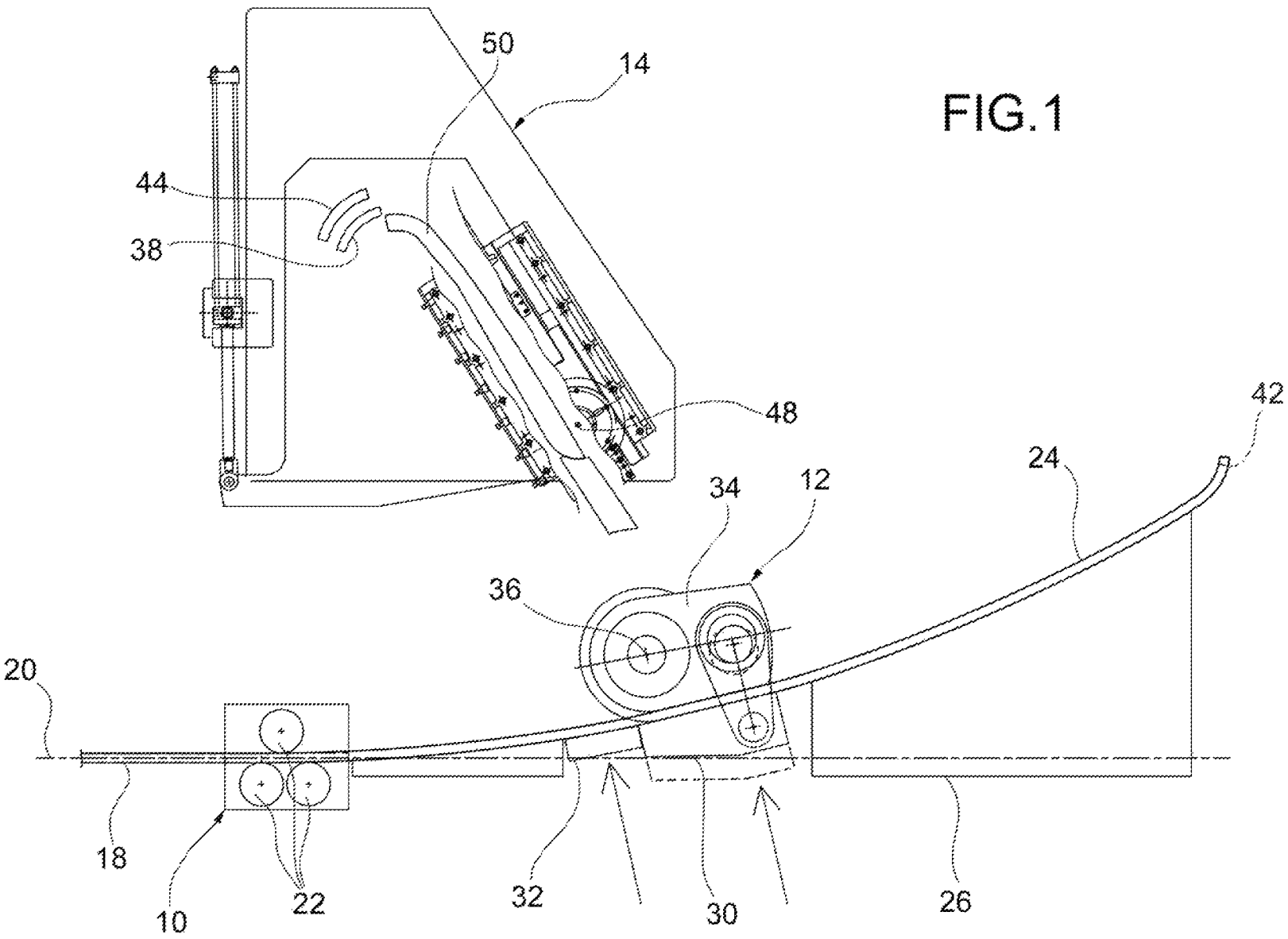
FIGS. 1 to 10 are schematic representations of successive steps of the method according to the invention.

In particular, it should be noted that the final curvature of the central portions of the pieces 16, which may be constant or may vary, possibly from point to point, is imparted by the stretch-bending station 14, while the final curvature of the two ends of each piece 16 is imparted by the wrap-bending station 12 in two successive operating cycles, in each of which one of these ends is bent. In fact, as shown in FIG. 1, the distal end 42 of the element 18, intended to form one of the ends of the piece 16*a* produced by the sequence of steps described above, has already been curved in a previous operating cycle. Similarly, the result of the sequence of steps described above is not only the curvature of the further end 56 of the piece 16*a*, but also the curvature of a first end 42 (see FIG. 10) of the next piece to be produced, again from the element 18, by procedures similar to those described above. This is further demonstrated by the fact that, after the cutting of the piece 16*a* shown in FIG. 10, the remainder of the element 18 is in a configuration corresponding to that shown in FIG. 1, and is ready to be subjected to the wrap-bending and subsequent operating steps described above.

Naturally, the principle of the invention remaining the same, details of construction and embodiments may be varied with respect to those described, which have been given purely by way of example, without thereby departing from the scope of the invention as described and claimed herein. For example, methods according to the invention may consist solely of the steps indicated above, or may comprise further steps performed before, after and/or between the aforesaid steps.

The invention claimed is:

1. A method for the production of a curved piece from a continuous metal element, which is a profiled element or a tube, extending along a longitudinal axis and advancing along a direction defined by said longitudinal axis, said method comprising the steps of:

advancing said continuous metal element through a calendering station such that each length of the continuous metal element assumes a pre-established curvature, stopping advancement of the continuous metal element after a curved portion thereof has passed through a wrap-bending station located downstream of the calendering station and is supported by a support, wrap-bending the length of the element located at said wrap-bending station and gripped by a block, by rotation of said block and a body of the wrap-bending station about a fixed pivot, while simultaneously conveying said curved portion to a stretch-bending station, wherein a distal end of said continuous metal element is locked by a clamp, stretch-bending said curved portion by a rotary movement about a translating pivot of a shaping element which comes into contact with said curved portion, resuming advancement of the continuous metal element until the wrap-bent length is at a cutting station, and cutting said continuous metal element in the wrap-bent length, thus producing the curved piece.

2. The method of claim 1, wherein the pre-established curvature imparted by said calendering station is determined independently for each length of the continuous metal element.

3. The method of claim 1, wherein a final curvature of each length of the piece is determined independently of that of adjacent lengths.

4. The method of claim 1, wherein said piece is a rib having strongly curved ends and a gently curved central portion.

5. The method of claim 4, wherein the curvature of said strongly curved ends is imparted by said wrap-bending station and the curvature of the gently curved central portion is imparted by said stretch-bending station.

6. The method of claim 1, wherein said cutting station is a laser cutting station.

7. The method of claim 1, wherein said continuous metal element is cut approximately in the center of the wrap-bent length.

8. The method of claim 1, wherein said calendaring station comprises a plurality of rollers which are selectively movable relative to one another to form a passage for said continuous metal element.

* * * * *